US008535097B2

(12) United States Patent
Yen et al.

(10) Patent No.: US 8,535,097 B2
(45) Date of Patent: Sep. 17, 2013

(54) ELECTRICAL CONNECTOR WITH IMPROVED MATING MEANS

(75) Inventors: Ming Hui Yen, New Taipei (TW); Chun Chi Chou, New Taipei (TW)

(73) Assignee: Chant Sincere Co, Ltd., New Taipei ( * ) Notice: Subject to any disclaimer, the term of this patent is extended or adjusted under 35 U.S.C. 154(b) by 0 days.

(21) Appl. No.: 13/487,286

(22) Filed: Jul. 11, 2012

(65) Prior Publication Data

US 2013/0035001 A1 Feb. 7, 2013

(30) Foreign Application Priority Data

Aug. 5, 2011 (TW) ..... 100214552 U

(51) Int. Cl.
*H01R 24/00* (2011.01)

(52) U.S. Cl.
USPC ..... 439/607.27; 439/607.4

(58) Field of Classification Search
USPC ..... 439/660, 607.27–607.4
See application file for complete search history.

(56) References Cited

U.S. PATENT DOCUMENTS

| | | | | |
|---|---|---|---|---|
| 7,604,512 | B1 * | 10/2009 | Chen | 439/660 |
| 2005/0124219 | A1 * | 6/2005 | Chen et al. | 439/607 |
| 2009/0124134 | A1 * | 5/2009 | Moriyama et al. | 439/660 |
| 2011/0281468 | A1 * | 11/2011 | Yu et al. | 439/660 |

* cited by examiner

*Primary Examiner* — Phuong Dinh
(74) *Attorney, Agent, or Firm* — Bacon & Thomas, PLLC

(57) ABSTRACT

An electrical connector comprising an insulative housing, a plurality of terminals, a detect pin and a shell, includes a insulative housing having a terminal seat extending forwardly from a base portion and configuring a tongue, and defining a receiving room between bottom of the tongue and a shell, and a plurality of terminals installed in the terminal seat containing nineteen pins compacting to transmit HDMI signals and with one plus pin compacting to transmit DisplayPort signals, and a shell accommodating the insulative housing and including a first engagement portion, a second engagement portion, and a third engagement portion.

6 Claims, 9 Drawing Sheets

ELECTRICAL CONNECTOR WITH IMPROVED MATING MEANS

BACKGROUND OF THE INVENTION

1. Field of the Invention

The present invention relates generally to an electrical connector, and more specifically, to an electrical connector that improving the mating means thereof, wherein providing a solution to insert different type plugs into identical connector free from destructing itself.

2. Description of the Related Art

Technologies today have been transformed rapidly. They are utilized approximately in all social sectors and closely connect with people's life. Communication technology applied in those computer-peripheral devices generally uses transmission cables to up/download with mass data. The plug assembled with a cable, which is predetermined to be inserted into a socket on a device, thus plays a role as being a key element in communication technology.

By year to year, since markets replaced and products retired, the following standards "High Definition Multimedia Interface", abbreviated as "HDMI" promoted by HDMI Licensing, LLC and "DisplayPort" by VESA, are created to behave in addition with high performance, somehow being the next urge-to-use Input/Output components in the digital world.

HDMI and DisplayPort known as high performance characteristics use commonly nineteen terminals. Except one plus terminal is employed as running advanced function for DisplayPort. The width dimensions of these two were usually different resulted in the appearance differences between HDMI and DisplayPort.

Taiwan Patent Nos. M362544, M330608 disclose electrical connectors of which HDMI and DisplayPort plug are able to be inserted into an identical shielding. Though such connector decreases size and still adopts only single port that seems a great idea to miniaturize connector, however, a problem occurs wherein conventional art uses a tongue portion in order to guide the plug. In condition of HDMI plug having a small size than DisplayPort plug, conventional art fails to provide a position function in a simple way. So failures always happen during plugging and worsen to the risk of tongue-damaging, even the risk of housing-damaging, as users are trying to accurately position the plug. Looking into many other mating means, such plug connector fails to provide an efficient detecting/guiding mechanism to identify two plugs. Such drawback obviously is a potential risk to the device makers, at the time that devastated quality issue from adopted parts is not allowed, or otherwise it is eventually being harmful to selling products.

SUMMARY OF THE INVENTION

For solving the poor situation occurred in conventional art, therefore, it is necessary to modify and to find an improved means for mating electrical connector, thereto providing a solution to insert different type plugs into identical connector without bringing destruction to itself.

The present invention is ultimately to provides an electrical connector, comprising an insulative housing, a plurality of terminals, a detect pin and a shell assembly. The insulative housing has a terminal seat wherein extending forwardly from a base portion and configuring a tongue, and defines a receiving room between bottom of the tongue and a shell. The plurality of terminals is installed in the terminal seat, wherein containing nineteen pins compacting to transmit HDMI signals, and with one plus pin compacting to transmit DisplayPort signals. The shell accommodates the insulative housing, and includes: a first engagement portion defined at one side of tongue, extending a first arm in curve shape to an opening of the shell and configuring a first stop toward to the receiving room, wherein the first arm corresponding to a ramped portion of said shell, a third engagement portion defined at vertical direction of the first engagement portion extending a third arm in curve shape to the opening, and a second engagement portion defined at horizontal direction of the third engagement portion, extending a second arm in curve shape to the opening and configuring a second stop toward to the receiving room.

The tongue of terminal seat provides recessions at both top and bottom sides of the tongue for receiving the contact ends of the terminals.

The electrical connector further comprises a detect pin attached to the terminal seat including a body portion, a resilient finger and a soldering tail wherein the body portion disposed in terminal seat and the resilient finger disposed near the tongue.

The insulative housing includes a block holding soldering tails of the terminals and the detect pin through holes on the block. The terminal seat extends backwardly from the base portion and configures two extension portions, wherein the block fixed between the extension portions.

Each extension portion contains an aperture at inner side and the block configures tabs to engage with the apertures thereof.

The shell is assembled of a first shell and a second shell attached out of the first shell, wherein the first engagement portion configured at the first shell and the second engagement portion configured at said second shell with the third engagement portion.

As the DisplayPort plug is inserting into receiving room, the plug pushes the first engagement portion, third engagement portion and second engagement portion, and leads to physically distort and space out of former place. And detect pin is butted and touches to the shell, in which a detecting signal is sent to a circuit board, and finally the DisplayPort plug approximately connects to electrical connector therein.

The present invention is further to provide an electrical connector. As comparatively smaller HDMI plug inserting into the receiving room, the one side (e.g. right) of plug must be positioned to a side wall (e.g. right) of the shell which is the side just opposed to the ramped portion, to ensure the third engagement portion spacing out of former place. Thus, the other side (e.g. left) of plug is eventually able to be inserted in. Otherwise, once the HDMI plug fails to be positioned as mentioned, the first engagement portion and the third engagement portion unfavorably cease the moving plug. If so, the HDMI plug is hard to be inserted in, and not able to connect to electrical connector.

DETAILED DESCRIPTION OF THE EMBODIMENT(S)

Figure 1:
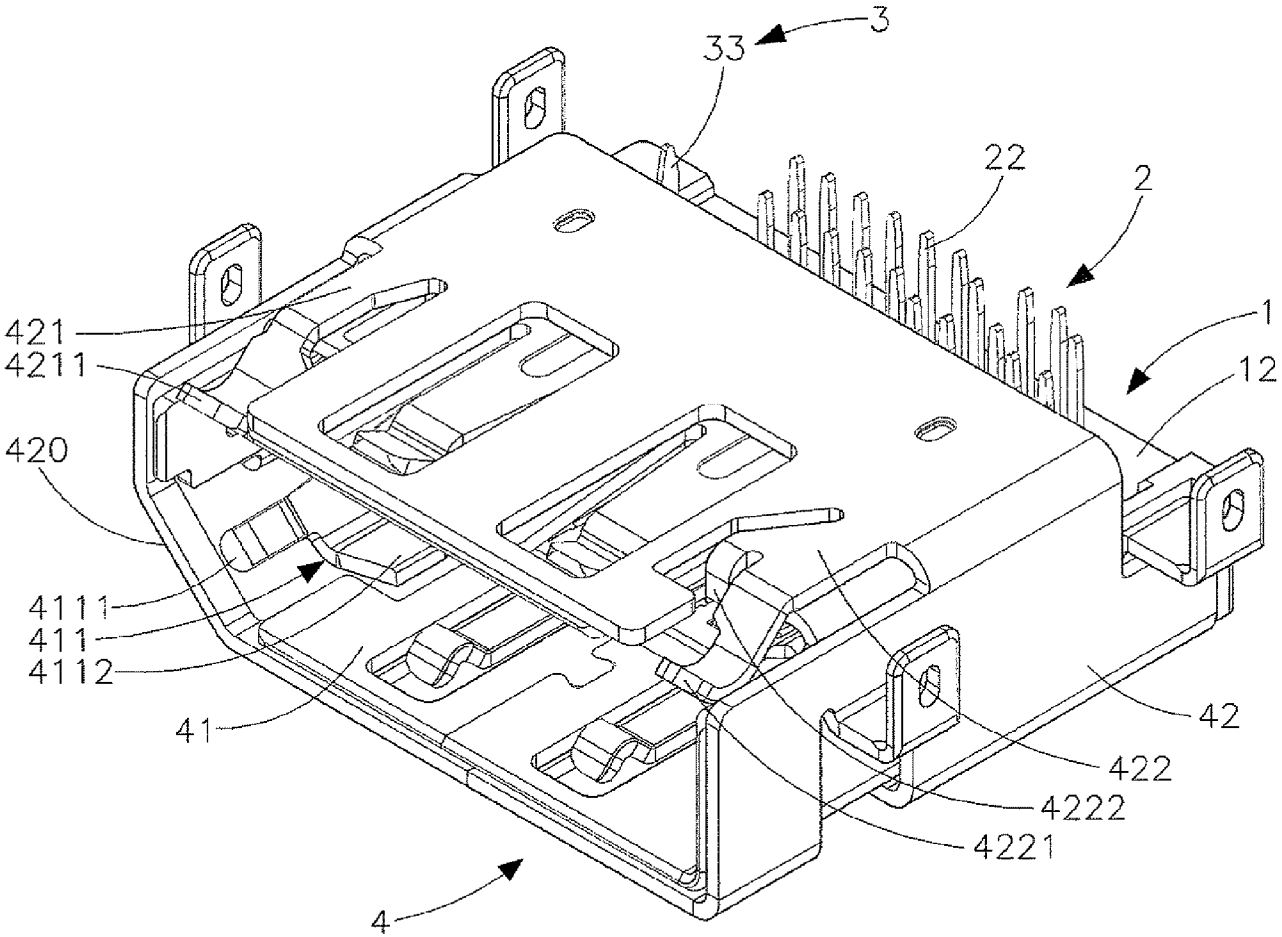
FIG. 1 is a perspective view of the electrical connector formed in accordance with an embodiment of the invention.
Figure 2:
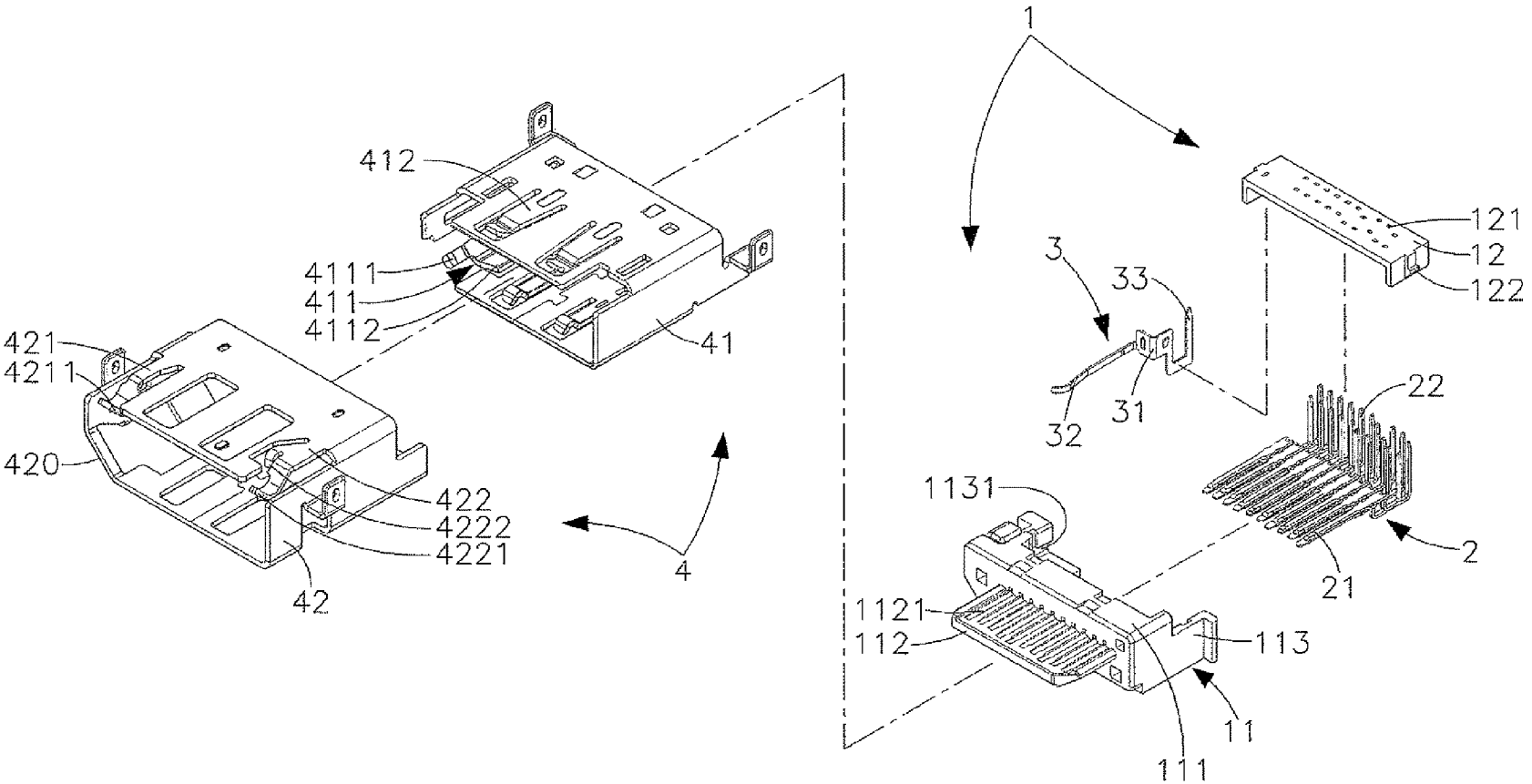
FIG. 2 is an exploded perspective view shown in FIG. 1.
Figure 3:
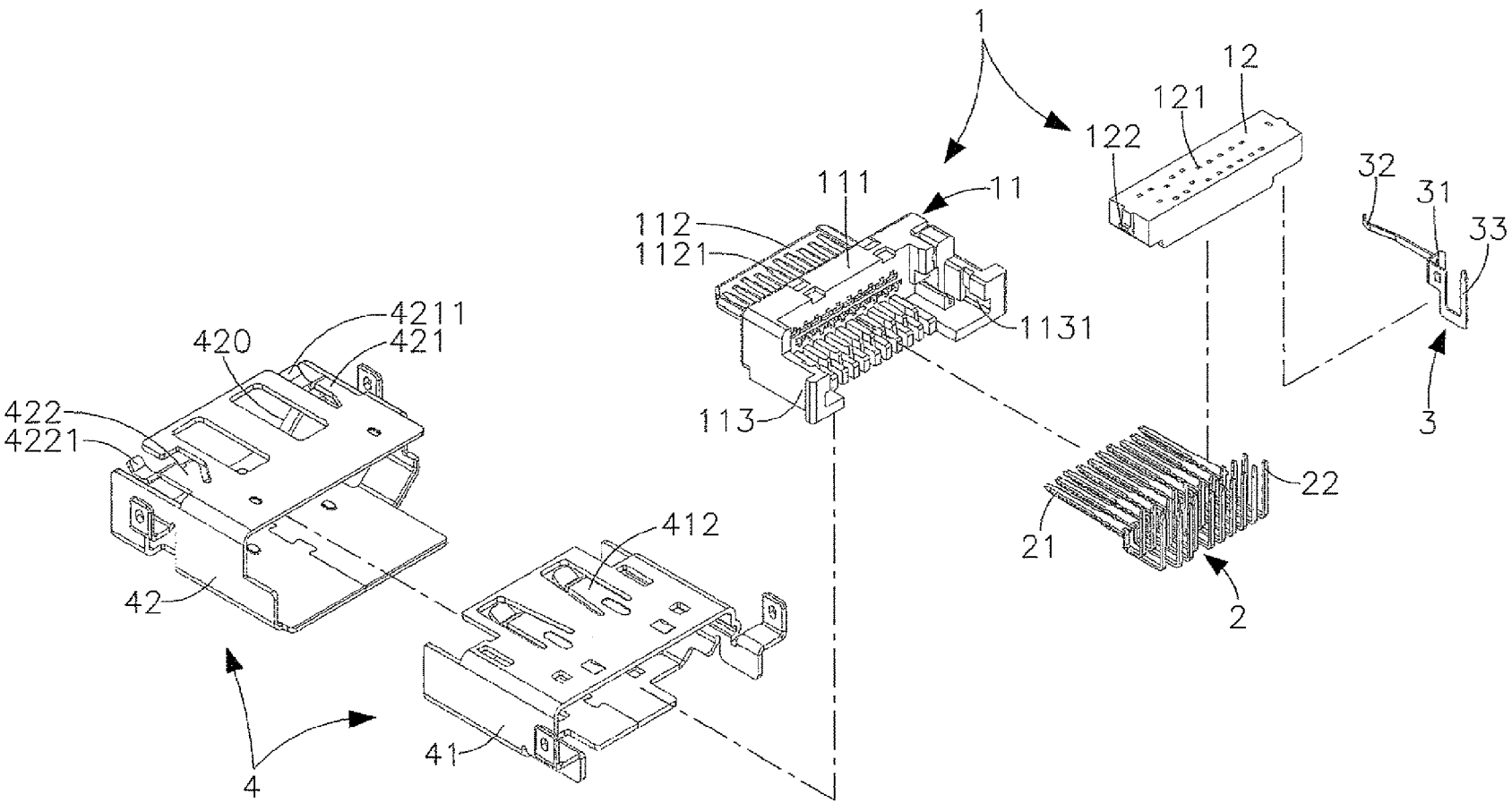
FIG. 3 is another exploded perspective view shown in FIG. 1.

As shown in FIGS. 1-3, the present embodiment is illustrated in a perspective view and exploded perspective views. An electrical connector comprises: an insulative housing 1, a plurality of terminals 2, a detect pin 3 and a shell assembly 4.

The insulative housing 1 consists of a terminal seat 11 and a block 12. Terminal seat 11 extended forwardly from a base portion 111 configures a tongue 112, wherein recessions 1121 are provided at both top and bottom sides of tongue 112. Terminal seat 11 extended backwardly from base portion 111 configures two extension portions 113 wherein each extension portion 113 contains an aperture 1131 at inner side. Block 12 consists of holes 121 on surface and tabs 122 which configure to engage with apertures 1131.

A plurality of terminals 2 is installed in terminal seat 11 wherein each terminal has a contact end 21 disposed in the recession 1121 and a soldering tail 22 passing through the hole 121 of block 12. A plurality of terminals 2 contains nineteen pins which are compact to perform HDMI transmission, and additionally contains one pin which is performing with above-mentioned 19 pins so entire terminal set 2 is able to be compacting to DisplayPort transmission.

Detect pin 3 is attached to terminal seat 11 and comprises a body portion 31 disposed at one of extension portions 113, a resilient finger 32 disposed near tongue 112, and a soldering tail 33 passing through the hole 121 of block 12.

Shell assembly 4 engages with insulative housing 1 and further includes a first shell 41 and a second shell 42 of which the second shell 42 approximately is attached to the first shell 41. A first engagement portion 411 on first shell 41 is defined at one side of tongue 112 and rests under the resilient finger 32 of the detect pin 3. First engagement portion 411 extends a first arm 4111 in curve shape to the shell 4 opening and configures a first stop 4112 toward to the first shell 41. First arm 4111 is corresponding to a ramped portion 420 on second shell 42. Third engagement portion 421 on second shell 42 is defined at vertical direction of the first engagement portion 411 and extends a third arm 4211 in curve shape to the shell 4 opening. Moreover, second engagement portion 422 on second shell 42 is defined at horizontal direction of the third engagement portion 421. Second engagement portion 422 extends a second arm 4221 in curve shape to the shell 4 opening and configures a second stop 4222 toward to the first shell 41. On the topside of first shell 41, at least one latch 412 joins the receiving room in order to lock a plug.

Figure 4:
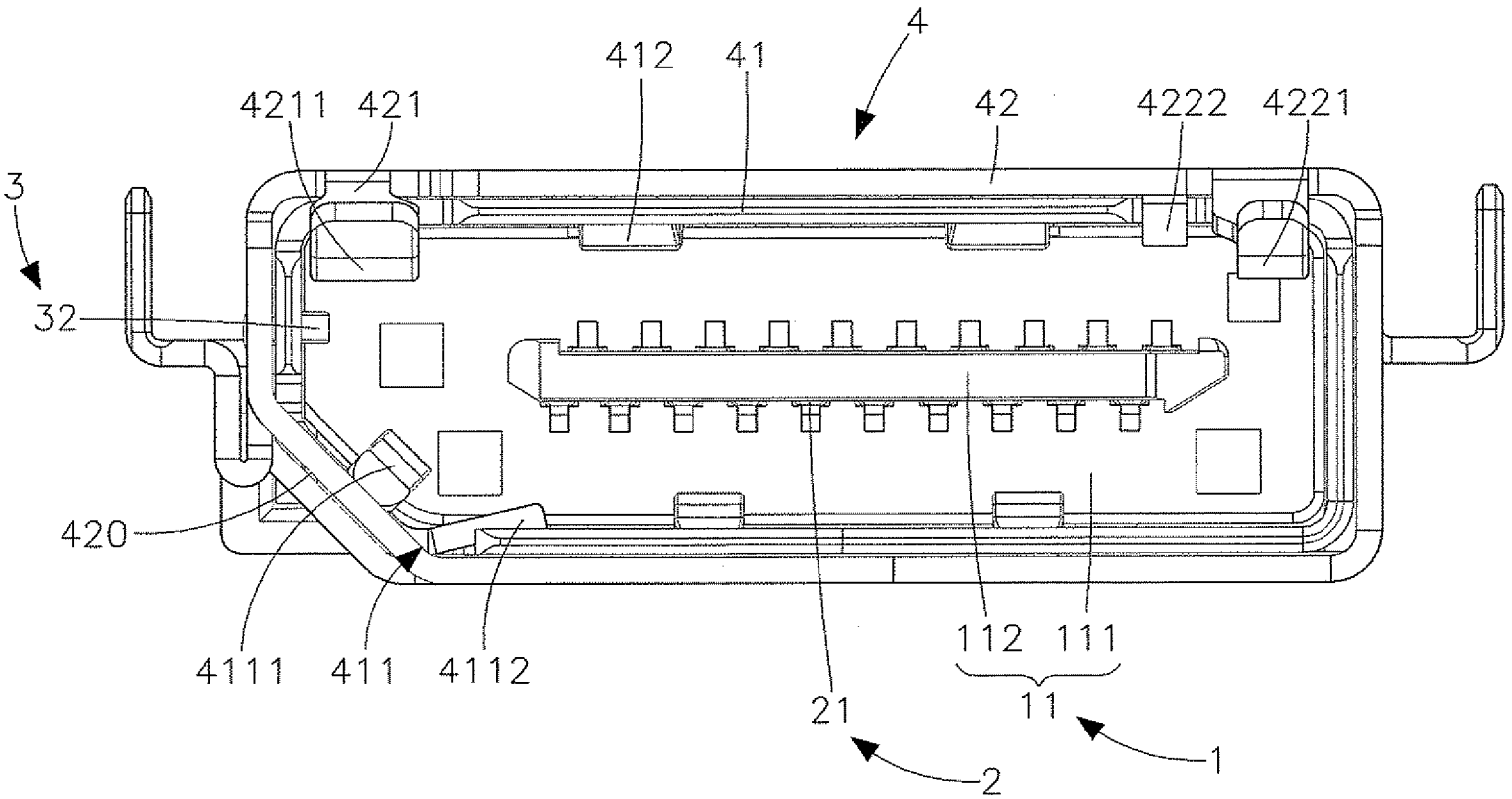
FIG. 4 is a front view of the electrical connector formed in accordance with an embodiment of the invention.
Figure 5:
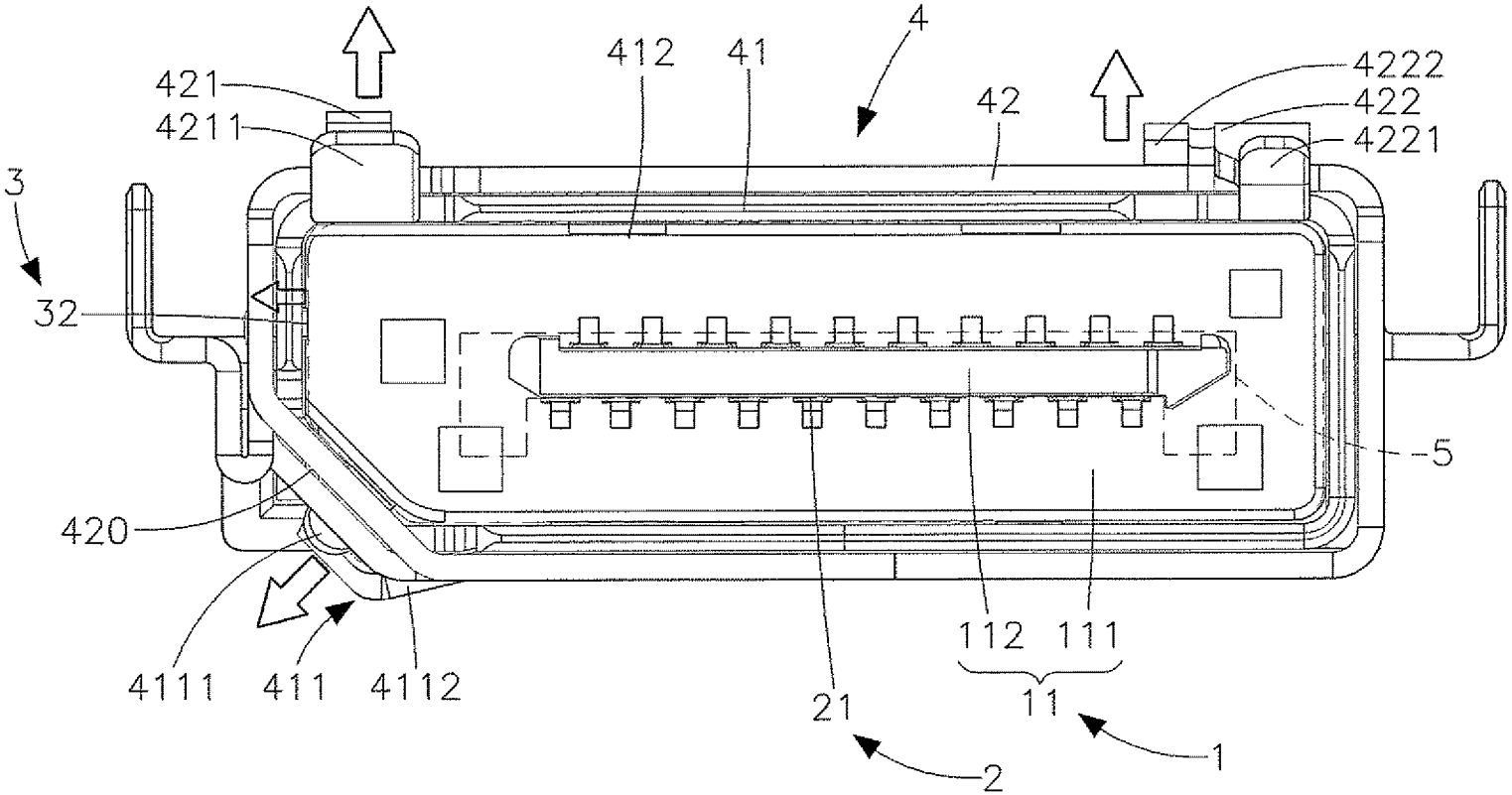
FIG. 5 is a front view of the electrical connector shown in FIG. 4, illustrated a DisplayPort plug outline inside the connector.
Figure 6:
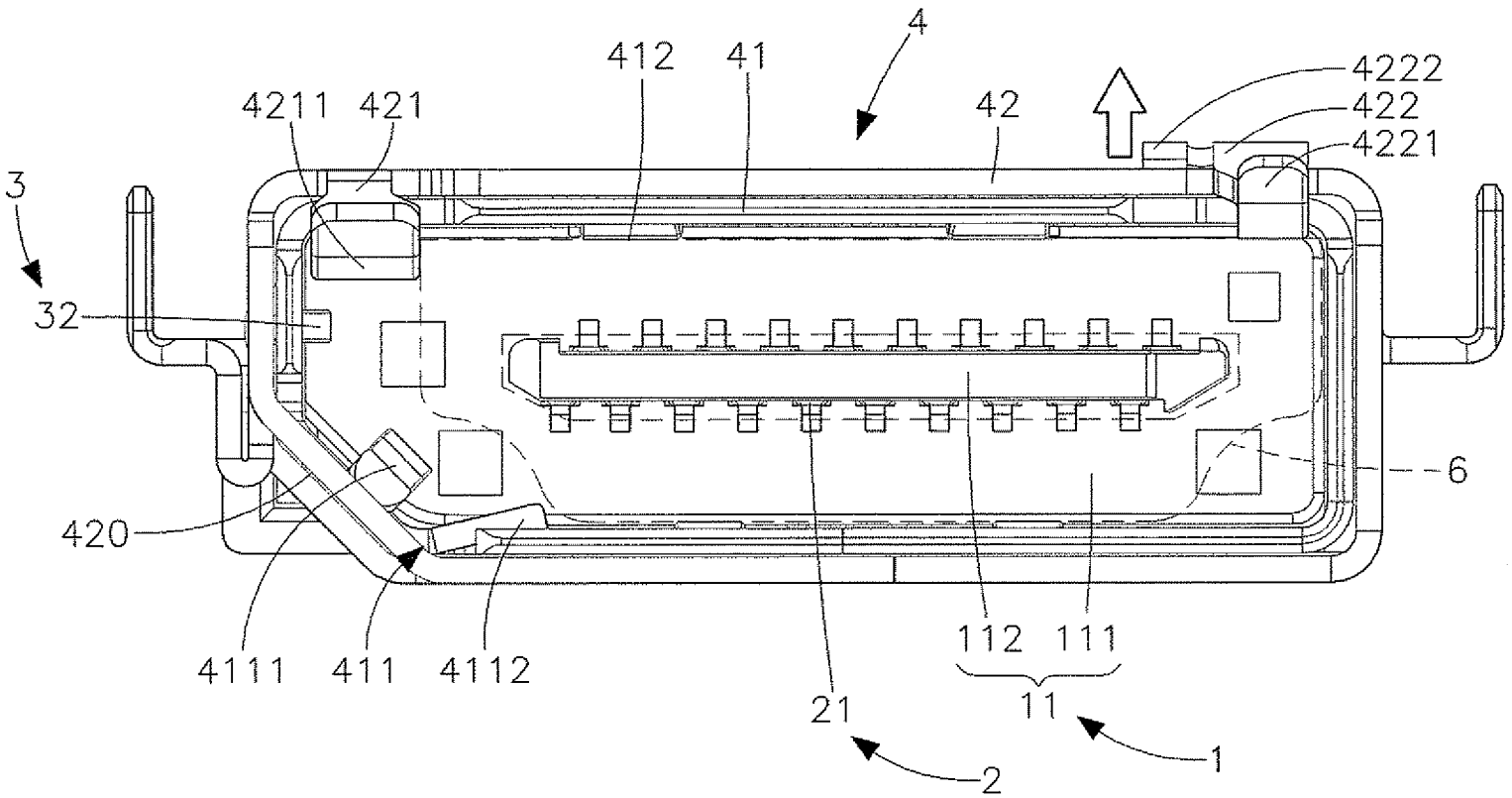
FIG. 6 is a front view of the electrical connector shown in FIG. 4, illustrated a HDMI plug outline inside the connector.
Figure 7:
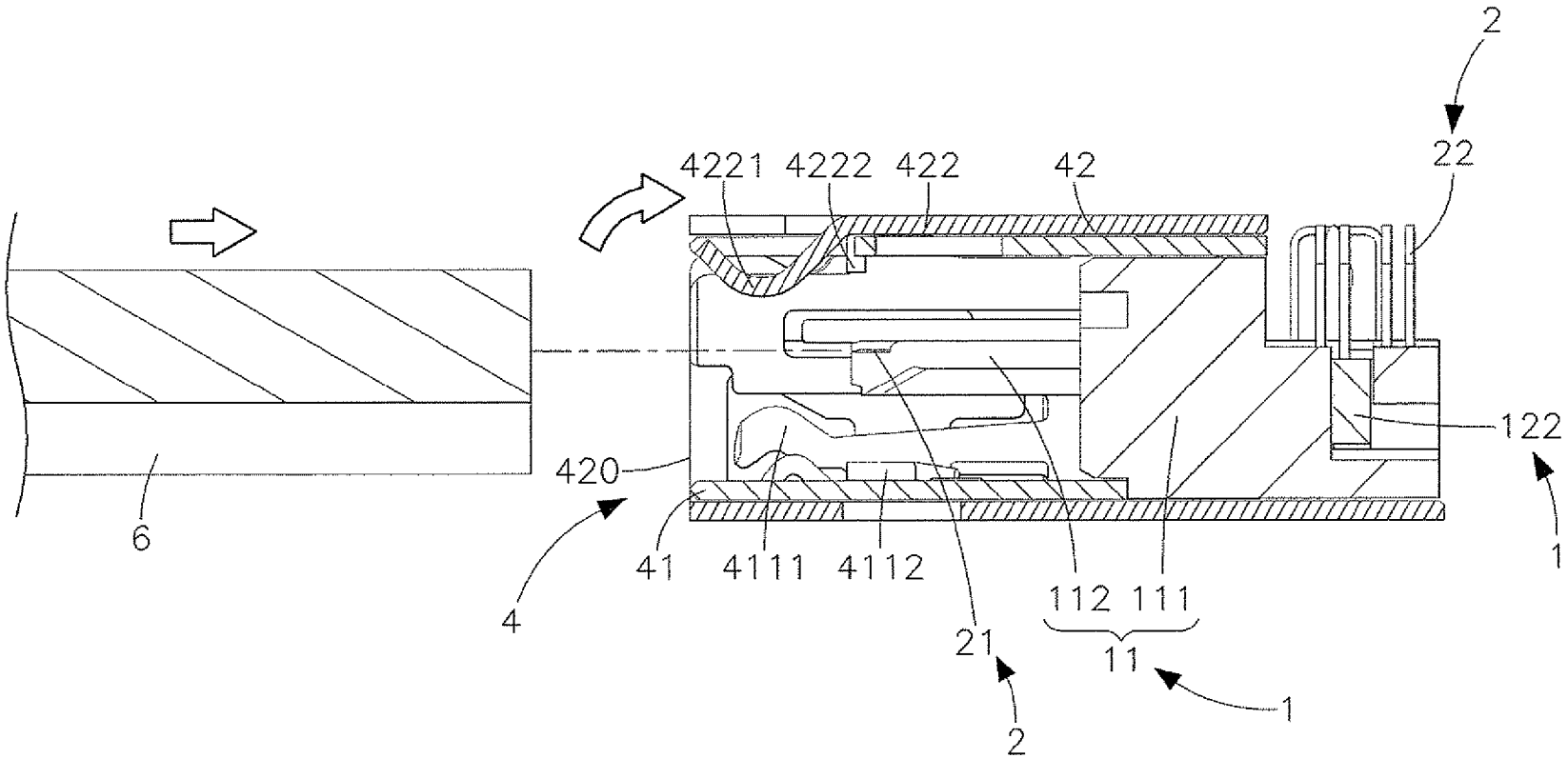
FIG. 7 is a cross-section view of the electrical connector before connecting with a HDMI plug connector in accordance with an embodiment of the invention.
Figure 8:
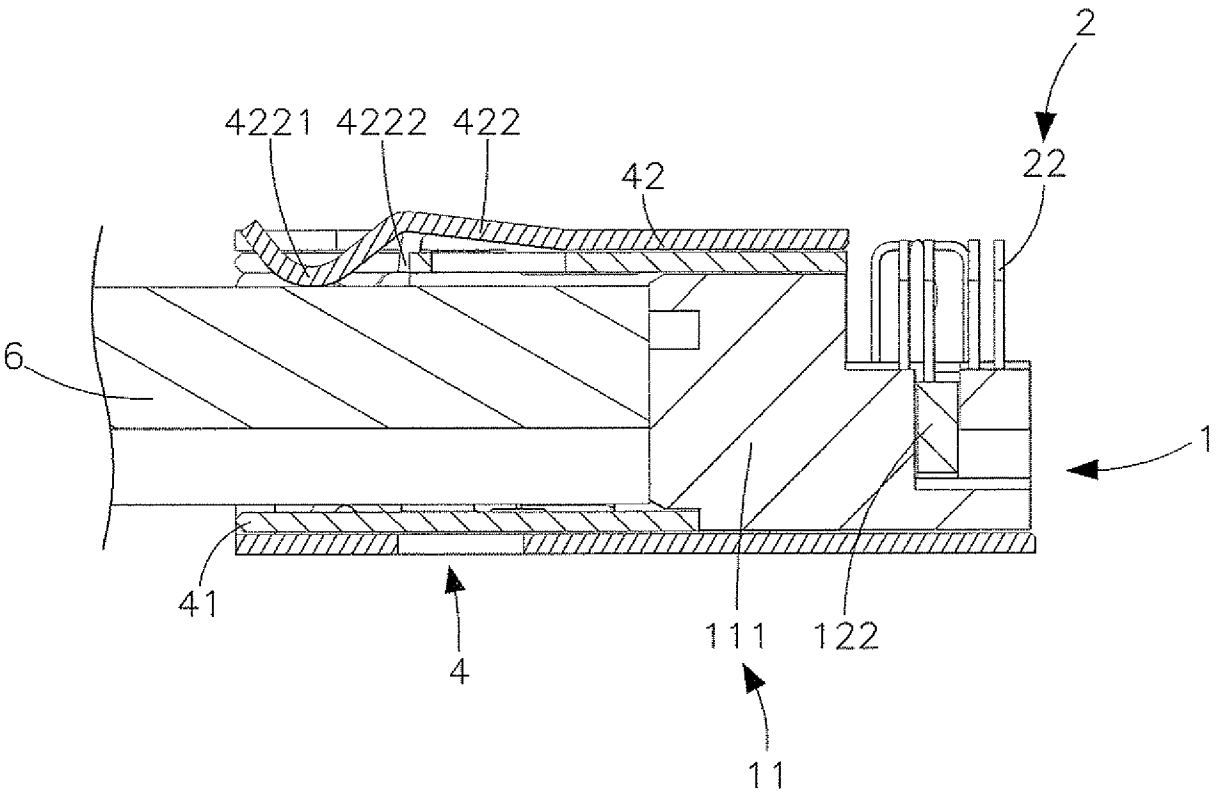
FIG. 8 is a cross-section view of the electrical connector shown in FIG. 7 after connecting with a HDMI plug connector.
Figure 9:
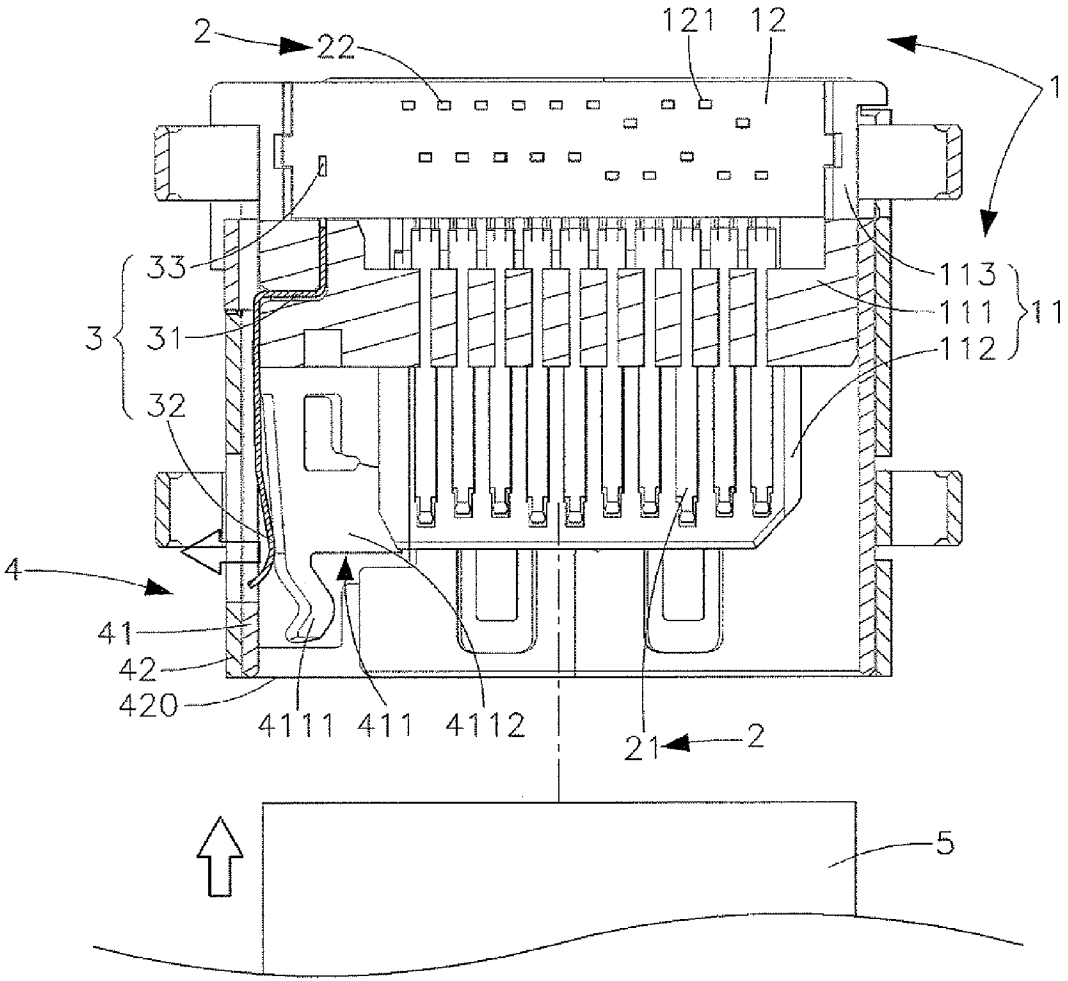
FIG. 9 is a vertical cross-section view of the electrical connector predetermined to connect a DisplayPort plug connector in accordance with an embodiment of the invention.

As FIG. 4 further illustrated a front view of the present embodiment, as assembling connector, first of all, a plurality of terminal 2 is inserted into the base portion 111 of the terminal seat 11, wherein each contact 21 of terminal is disposed in the recession 1121 which is configured at the tongue 112. Next, the body portion 31 of the detect pin 3 is mounted on the one of extension portion 113 of the terminal seat 11, wherein the resilient finger 32 of the detect pin 3 extends and is retained close to one side of tongue 112.

Soldering tails 33 of both terminals 22 and detect pin 3 are passing through the hole 121 of the block 12. Thus, the block 12 holding the terminals 22 approximately is pressed in the terminal seat 11, wherein latches 122 of block 12 engages with the aperture 1131 of the extension portion 113 and fixes.

First shell 41 is assembled within the second shell 42. And the second shell 42 ultimately accommodates the insulative housing 1 defining a receiving room between the bottom of tongue 112 and shell assembly 4. In the end, the first engagement portion 411 is corresponding to a ramped portion 420 configured upon the second shell 42. Third engagement portion 421 is defined at vertical direction of the first engagement portion 411 and the second engagement portion 422 is defined at horizontal direction of the third engagement portion 421.

As shown in FIGS. 5-9, the present embodiment is illustrated in front views and cross-section views that are directed to HDMI/DisplayPort plug outline inside the connector, electrical connector before/after connecting with a HDMI plug connector, and a vertical view of the electrical connector predetermined to connect a DisplayPort plug connector.

As the DisplayPort plug 5 inserting into receiving space, the plug 5 pushes the first arm 4111 of first engagement portion 411, the third arm 4211 of third engagement portion 421 and the second arm 4221 of second engagement portion 422, and leads to physically distort all engagement portions 411, 421, 422. By such distortion, the first arm 4111 of first engagement portion 411 and the second min 4221 of second engagement portion 422 are spacing out of former (original) place resulting in the first stop 4112 and second stop 4222 withdrawing from the receiving room. And the resilient finger 32 of the detect pin 3 is butted and touches the shell 4, in which a detecting signal is sent to the circuit board. Finally, the DisplayPort plug 5 approximately connects to the electrical connector thereby.

As comparatively smaller HDMI plug 6 inserting into the receiving room, the one side (e.g. right) of plug 6 must be positioned to a side wall of shell 4 which is oppose to ramped portion 420, to ensure that the second arm 4221 of second engagement portion 422 is spacing out of former place and withdrawing the second stop 4222 from the receiving room. In the same time, the first arm 4111 of first engagement portion 411 and third arm 4211 of third engagement portion 421 are not moving. So the other side (e.g. left) of plug 6 favorably passes without halting by the first stop 4112 and eventually inserts in. Otherwise, once the HDMI plug 6 fails to be positioned as mentioned, the first stop 4112 and the second stop 4222 unfavorably cease(stop) the plug 6. If so, the HDMI plug 6 is hard to be inserted in, and not able to connect to electrical connector.

The present invention provides a simple way of which an electrical connector mounted on the P.C.B. is able to distinguish types of plug plugging in. The detect pin is contacting to DisplayPort plug when the plug inserts in. Anticipatively, the sending signals are distinguished as DisplayPort signals. As the detect pin is not contacting/butted to any plug, the sending signals, therefore, should be HDMI signals.

The present embodiment provides a shell assembly which initiates to combine the first shell and the second shell. Those skilled in the art will recognize that the invention can be practiced with modification that using one or more shells, within the spirit and scope of the claims.

While the invention has been described in terms of various specific embodiments, those skilled in the art will recognize that the invention can be practiced with modification within the spirit and scope of the claims.

What is claimed is:

1. An electrical connector, comprising:

an insulative housing having a terminal seat extending forwardly from a base portion to configure a tongue, and defining a receiving room between bottom of said tongue and a shell; and a plurality of terminals installed in said terminal seat containing nineteen pins compacting to transmit HDMI signals, and compacting to transmit DisplayPort signals with one plus pin; and said shell accommodating said insulative housing, and including a first engagement portion defined at one side of tongue, extending a first arm in curve shape to an opening of said shell and configuring a first stop toward to said receiving room wherein said first arm corresponding to a ramped portion of said shell, a third engagement portion defined at vertical direction of said first engagement portion extending a third arm in curve shape to said opening, and a second engagement portion defined at horizontal direction of said third engagement portion, extending a second arm in curve shape to said opening and configuring a second stop toward to said receiving room.

2. The electrical connector of claim 1, wherein said tongue of the terminal seat providing recessions at both top and bottom sides of said tongue, for receiving the contact ends of said terminals.

3. The electrical connector of claim 1, further comprises:

a detect pin attached to said terminal seat including a body portion, a resilient finger and a soldering tail wherein said body portion disposed in terminal seat and said resilient finger disposed near said tongue.

4. The electrical connector of claim 3, wherein said insulative housing including a block holding said detect pin and said soldering tails of the terminals through holes on said block, and said terminal seat extending backwardly from said base portion to configuring two extension portions, wherein said block fixed between said extension portions.

5. The electrical connector of claim 4, wherein each extension portion containing an aperture at inner side and said block configuring tabs to engage with said apertures.

6. The electrical connector of claim 1, wherein the shell assembled with a first shell and a second shell attached out of said first shell, wherein said first engagement portion configured at said first shell and said second engagement portion configured at said second shell with said third engagement portion.

* * * * *